US009657492B2

(12) United States Patent
Mansueto

(10) Patent No.: US 9,657,492 B2
(45) Date of Patent: May 23, 2017

(54) POLE-TYPE MEMBER SUPPORT DEVICE AND METHOD THEREFOR

(71) Applicant: Raul Mansueto, Las Vegas, NV (US)

(72) Inventor: Raul Mansueto, Las Vegas, NV (US)

( * ) Notice: Subject to any disclaimer, the term of this patent is extended or adjusted under 35 U.S.C. 154(b) by 0 days.

(21) Appl. No.: 14/806,497

(22) Filed: Jul. 22, 2015

(65) Prior Publication Data

US 2017/0022730 A1 Jan. 26, 2017

(51) Int. Cl.
*F16M 13/00* (2006.01)
*E04H 12/22* (2006.01)
*A47G 33/12* (2006.01)

(52) U.S. Cl.
CPC ..... *E04H 12/2269* (2013.01); *A47G 33/12* (2013.01)

(58) Field of Classification Search
CPC ..... A47G 33/12; A47G 2033/1286; E04H 12/2238; E04H 12/2269
USPC ..... 248/524, 523, 519, 511
See application file for complete search history.

(56) References Cited

U.S. PATENT DOCUMENTS 830,671 A 9/1906 Neff
2,761,641 A 9/1956 Lubbers Renso
4,119,290 A 10/1978 Gies
5,704,580 A * 1/1998 Peery, Jr. ..... E01F 9/623 248/345
6,070,848 A 6/2000 Ogren
6,087,946 A 7/2000 Menard, Jr.
6,745,991 B1 * 6/2004 Rush ..... A47G 33/12 248/523
6,818,264 B1 11/2004 Samperisi, Jr.
7,930,854 B1 * 4/2011 Zaverousky ..... A47G 33/12 47/40.5
8,091,853 B2 * 1/2012 Clores ..... A47G 33/12 248/523
2005/0229482 A1 10/2005 Wynn
2008/0035826 A1 2/2008 Clores et al.
2009/0100789 A1 4/2009 Hornbeak et al.
2010/0313471 A1 12/2010 Middaugh
2016/0186456 A1 * 6/2016 Mansueto ..... E04H 12/2238 248/523

* cited by examiner

*Primary Examiner* — Todd M Epps
(74) *Attorney, Agent, or Firm* — Weiss & Moy, P.C.; Jeffrey D. Moy

(57) ABSTRACT

A pole type member support device has a receptacle having an opening formed in a top section thereof. The receptacle is conical in shaped and tapered so that the top section of the receptacle is smaller than a bottom section of the receptacle. A tubular cut-out is formed within the receptacle and extends down from the opening. The tubular cutout is tapered so that the top section of the tubular cut-out is larger than a bottom section of the tubular cut-out. A plurality of ring members is provided wherein each ring member has an opening formed through a central area thereof, each opening having a diameter approximately equal to a diameter of a pole-type member, each of the plurality of ring members configured to be inserted and held within the tubular cut-out to support a pole-type member in an upright position within the tubular cut-out.

17 Claims, 4 Drawing Sheets

POLE-TYPE MEMBER SUPPORT DEVICE AND METHOD THEREFOR

FIELD OF THE INVENTION

This invention relates generally to pole-type member supporting devices and methods and, more particularly, to a pole-type member support device and method for securely supporting Christmas trees, artificial trees, umbrellas, and other elongated objects in an upright position for an extended period of time.

BACKGROUND OF THE INVENTION

During the holiday season, many people set up real and/or artificial Christmas trees in their homes for both decorative and religious purposes. The Christmas trees often vary in height and size, creating varying degrees of difficulty in supporting the trees in a stable position. Other people purchase or rent other types of trees, umbrellas, tiki torches, or other pole-type items for special events and occasions and/or everyday use or enjoyment. In these cases as well, it is difficult to support these items in a stable manner. Often, the result is that the trees, umbrellas, poles, or other items are either leaned against a wall or propped up in some other unstable way. This lack of a proper support device can lead to a number of unwanted consequences. A tree or umbrella falling from an unstable position can cause not only property damage but can also cause physical harm to a person. Likewise, a falling tiki torch or a pole-type item with a candle or other lit object on top could ignite a fire.

Previous attempts have been made to provide a support device for Christmas trees. For example, U.S. Pat. No. 5,970,655 issued to Freeman discloses a Christmas tree resting inside a collar member having a radial extension and a rod between the tree and the radial extension. The Freeman patent requires the attachment of a rod to a portion of the tree with set screws, a time-consuming and difficult process. The setting up of the rod assembly is a time-consuming and difficult process. Further, while natural, cut Christmas trees typically have trunks with flat bottom surfaces due to where they have been cut, the aforementioned pole-type members may lack flat bottom surfaces, particularly in instances where they are adapted to be staked into the ground, and would be prone to slipping in a support device like that of Freeman.

Another example is U.S. Pat. No. 5,137,246 issued to Idso. Idso discloses a stand for Christmas trees comprised of a base plate with a pair of spaced-apart upright brackets mounted thereon. The tree holder receptacle is pivotally mounted between the upright brackets so that it can move about a horizontal axis in order to orient the tree trunk to a generally vertical position. A pair of locking levers is associated with the upright brackets so that they can be releasably clamped to orient the tree holder receptacle in any desired position. A set screw is provided to accept the tree into the tree holder receptacle. Adjusting the set screw and the pair of locking levers in order to properly position the tree trunk is a time-consuming and difficult process.

Accordingly, there has been a need for a pole-type member support device which is of simplified construction, inexpensive to manufacture, simple to install, and that can securely hold Christmas trees and/or pole-type members of various diameters. The pole-type member support device would hold Christmas trees and/or a pole-type member in a fixed position for an extended period of time and which does not require the use of screw type locking devices to hold the Christmas trees and/or pole-type members in an upright position. It would thus be desirable to provide a pole-type member support device that addresses the aforementioned shortcomings of existing devices.

SUMMARY OF THE INVENTION

In accordance with an embodiment of the present invention, a pole-type member support device is disclosed. The pole type member support device has a receptacle having an opening formed in a top section thereof. The receptacle is conical in shaped and tapered so that the top section of the receptacle is smaller than a bottom section of the receptacle. A tubular cut-out is formed within the receptacle and extends down from the opening. The tubular cutout is tapered so that the top section of the tubular cut-out is larger than a bottom section of the tubular cut-out. A plurality of ring members is provided wherein each ring member has an opening formed through a central area thereof, each opening having a diameter approximately equal to a diameter of a pole-type member, each of the plurality of ring members configured to be inserted and held within the tubular cut-out to support a pole-type member in an upright position within the tubular cut-out.

In accordance with another embodiment of the present invention, a pole-type member support device is disclosed. The pole type member support device has a receptacle having an opening formed in a top section thereof. A tubular cut-out is formed within the receptacle and extending down from the opening. A plurality of ring members is provided wherein each ring member has an opening formed through a central area thereof, each opening having a diameter approximately equal to a diameter of a pole-type member, each of the plurality of ring members configured to be inserted and held within the tubular cut-out to support a pole-type member in an upright position within the tubular cut-out.

In accordance with another embodiment of the present invention, a pole-type member support device is disclosed. A pole type member support device has a receptacle having an opening formed in a top section thereof. A tubular cut-out is formed within the receptacle and extending down from the opening. The tubular cutout is tapered so that the top section of the tubular cut-out is larger than a bottom section of the tubular cut-out. A plurality of ring members is provided, wherein each ring member has an opening formed through a central area thereof, each opening having a diameter approximately equal to a diameter of a pole-type member, each of the plurality of ring members configured to be inserted and held within the tubular cut-out to support a pole-type member in an upright position within the tubular cut-out, wherein each of the plurality of rings are of a different outer diameter.

BRIEF DESCRIPTION OF THE DRAWINGS

Embodiments of the disclosure will become more fully understood from the detailed description and the accompanying drawings, wherein.

Common reference numerals are used throughout the drawings and detailed description to indicate like elements.

DETAILED DESCRIPTION

Figure 1:
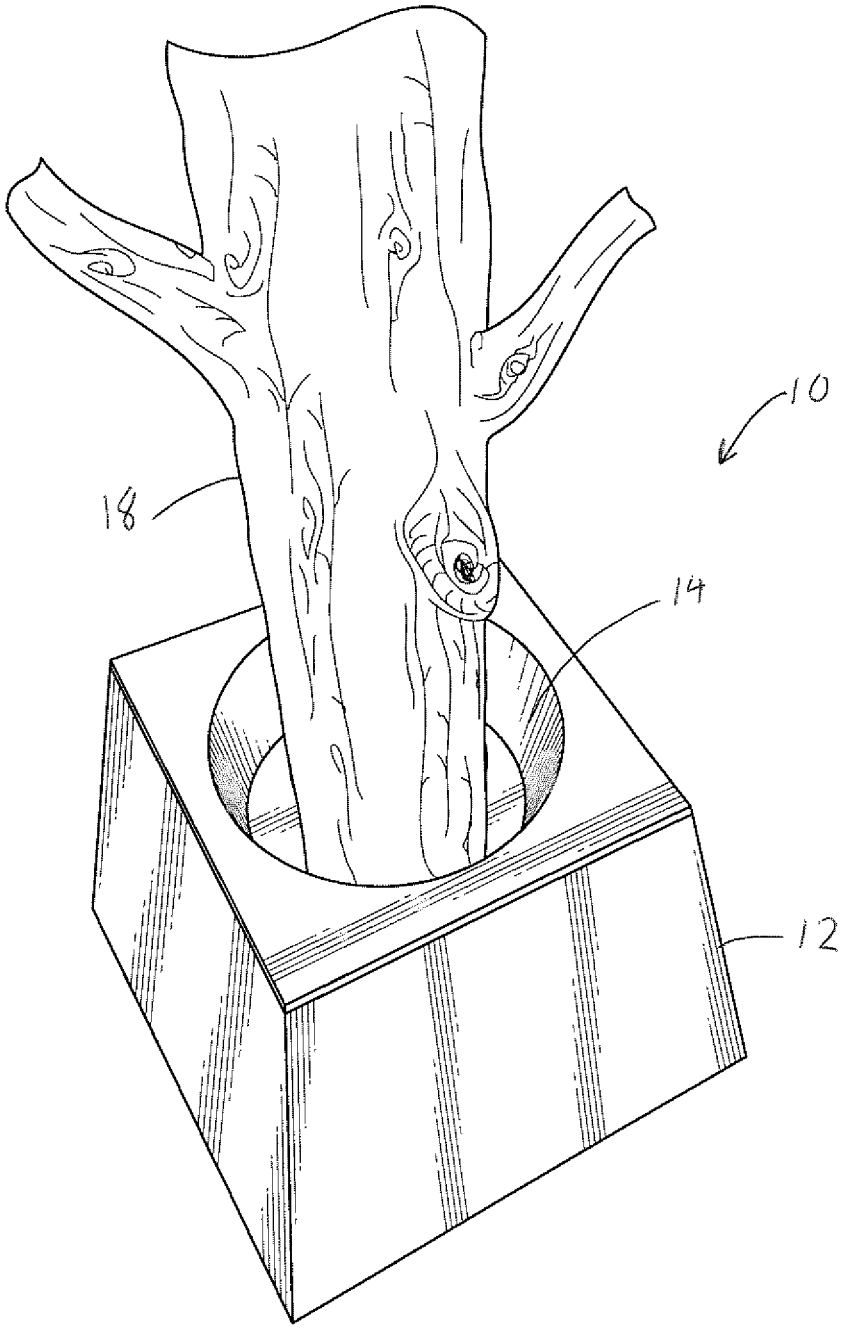
FIG. 1 is a perspective view of an adapter for a pole-type member support device supporting a tree, in accordance with an embodiment of the present invention.
Figure 2:
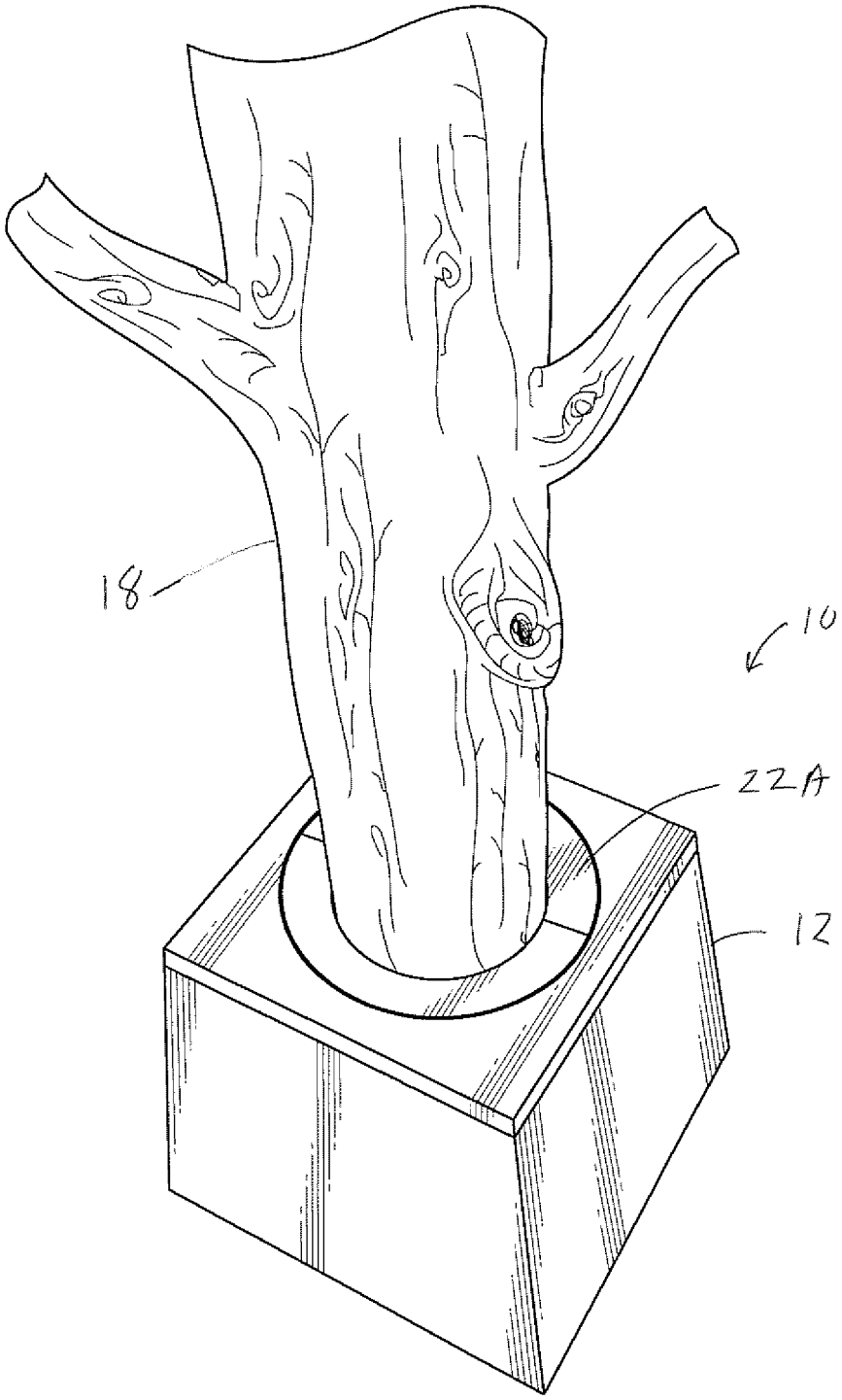
FIG. 2 is a perspective view of an adapter for a pole-type member support device with a top adapter ring supporting a tree, in accordance with an embodiment of the present invention.
Figure 3:
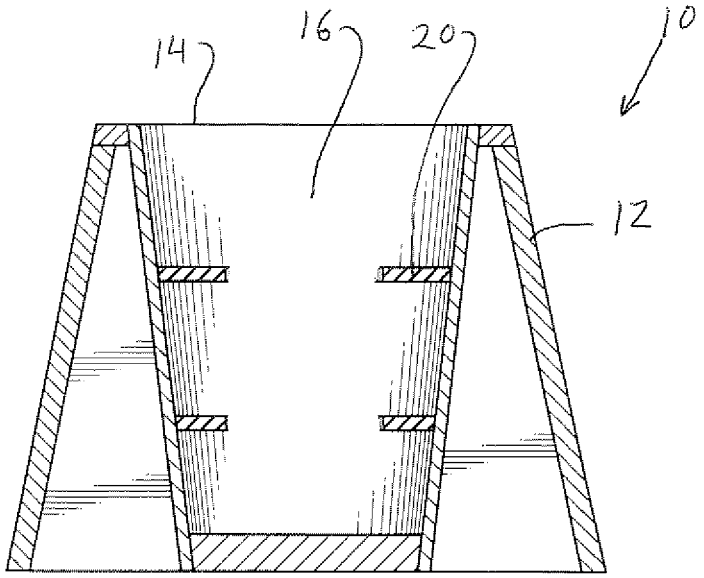
FIG. 3 is a cross sectional view of an adapter for a pole-type member support device of FIG. 1.

Referring to FIGS. 1-6, an embodiment of a pole-type member support device 10, hereinafter device 10, in accordance with an embodiment of the present invention is shown. The device 10 comprises, generally, a receptacle body 12. The receptacle body 12 is slightly tapered from a top section of the receptacle body 12 to a bottom section of the receptacle body 12 such that the top section is slightly smaller than the bottom section. The taper configuration provides a wider bottom surface for addition support. While the FIGs. show the receptacle body 12 being trapezoidal in shape, this is given as an example and should not be seen in a limiting manner.

The receptacle body 12 has a pole receiving opening 14 formed in the top section therein. The opening 14 may be formed in a central area of the top section of the receptacle body 12. The opening 14 is generally circular in shape but may be formed in other configurations without departing from the spirit and scope of the present discourse. The opening 14 leads to a cut-out 16 formed in the interior of the receptacle body 12. In accordance with one embodiment, the cut-out 16 may be conical in shape. Thus, the cut-out 16 may be tapered in shape so that a top section of the cut-out 16 is larger than the bottom section of the cut-out 16. The opening 14 and cut-out 16 are configured to receive a pole-type member 18 and for cooperatively holding the pole-type member 18 upright in the receptacle body 12.

A bottom section of the cut-out 16 may be enclosed by a bottom surface member 16A. The bottom surface member 16A may allow the cut-out 16, and hence the device 10, to be filled with and store a liquid such as water.

The device 10 may come with a plurality of ring members 22. The plurality of ring members 22 may come in a plurality of different diameters. Since the cut-out 16 may be conical in shape, the plurality of ring members 22 inserted into and held within the cut-out 16. Thus, one or more ring members 22 may be sized to fit in a lower section of the cut-out 16, one or more ring members 22 may be sized to fit in a middle section of the cut-out 16, and one or more ring members 22 may be sized to fit in an upper section of the cut-out 16.

Each ring member 22 will have an opening 24 formed through a central area thereof. The opening 24 may be sized to fit around the pole-type member 18 having an approximately equal diameter. A gasket 26 may extend from an inner diameter of each ring member 22. The gasket 26 may be used to form a seal around the pole-type member 18 and to prevent the pole-type member 18 from leaning.

Figure 4:
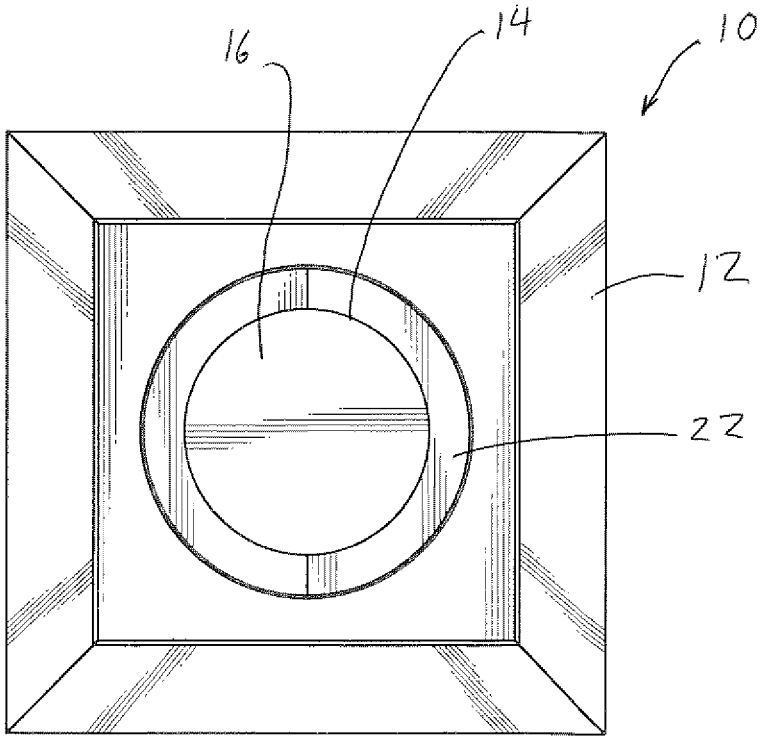
FIG. 4 is a top perspective view of an adapter for a pole-type member support device of FIG. 1.
Figure 5:
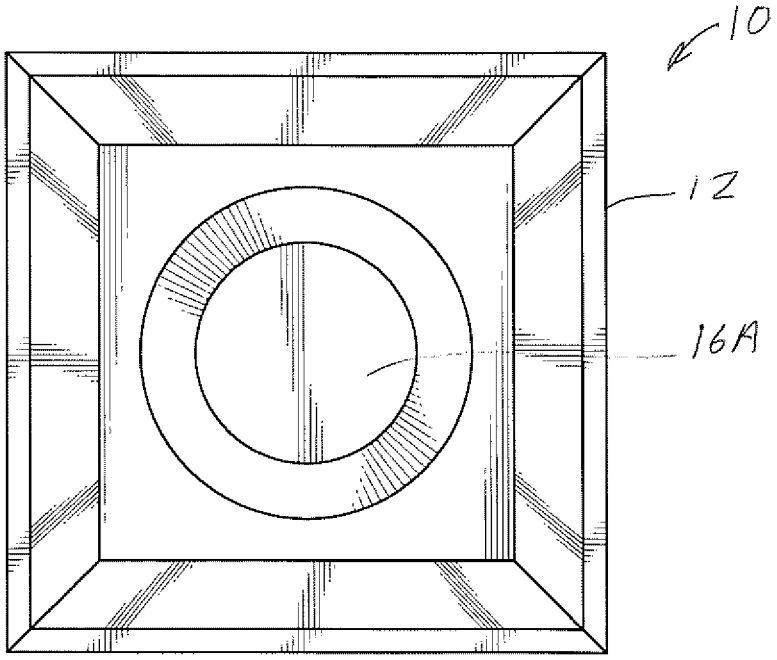
FIG. 5 is a bottom perspective view of an adapter for a pole-type member support device of FIG. 1.
Figure 6:
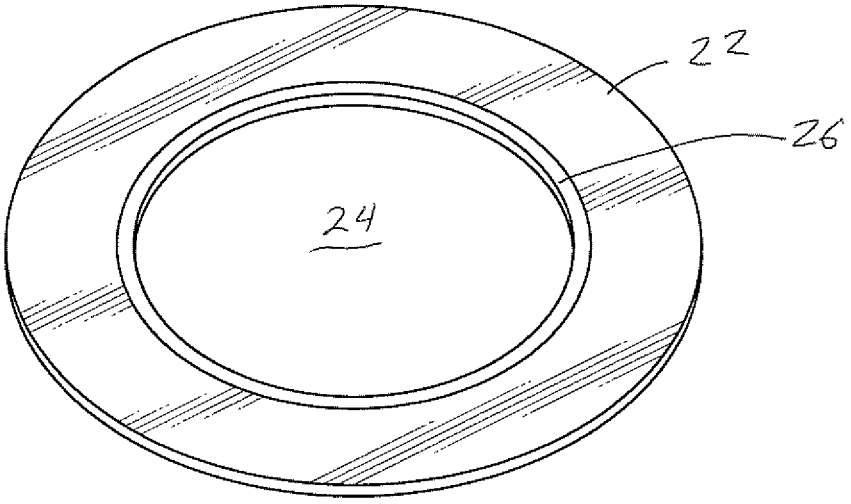
FIG. 6 is a perspective view of one adapter ring, in accordance with an embodiment of the present invention.

As may be seen in FIG. 4, a top ring member 22A may be inserted into and held within the cut-out 16. Due to the taper in the cut-out 16 and a size of the top ring member 22A, the top ring member 22A may sit approximately flush with a top surface 12A of the receptacle body 12.

In accordance with one embodiment, a plurality of ridge members 20 may be formed on an interior surface 16A of the cut-out 16. The ridge members 20 may be formed fully or partially along a perimeter of the interior surface 16A of the cut-out 16. The ridge members 20 may be formed to support and hold individual ring members 22 within positioned within the cut-out 16.

In operation, a user will place one or more ring members 22 around the pole-type member 18. The user may insert the pole-type member 18 through each ring member 22 such that the pole-type member 18 goes through the opening 24 formed through each ring member 22. The user may then insert the pole-type member 18 into the receiving opening 14 formed in the top section of the receptacle body 12. The ring members 22 will support the pole-type member 18 within the cut-out 16.

While embodiments of the disclosure have been described in tennis of various specific embodiments, it will be recognized and understood by those skilled in the art that the embodiments of the disclosure may be practiced with modifications without departing from the spirit and scope of the invention.

What is claimed is:

1. A pole type member support device comprising:

a receptacle having an opening formed in a top section thereof, the receptacle being conical in shaped and tapered so that the top section of the receptacle is smaller than a bottom section of the receptacle;

a tubular cut-out formed within the receptacle and extending down from the opening, wherein the tubular cutout is tapered so that the top section of the tubular cut-out is larger than a bottom section of the tubular cut-out; and a plurality of ring members, wherein each ring member has an opening formed through a central area thereof, each opening having a diameter approximately equal to a diameter of a pole-type member, each of the plurality of ring members configured to be inserted and held within the tubular cut-out to support the pole-type member in an upright position within the tubular cut-out.

2. The pole type member support device in accordance with claim 1, comprising a plurality of ridge members formed along an inner surface of the tubular cut-out.

3. The pole type member support device in accordance with claim 1, comprising a gasket formed around an inner diameter of at least one of the plurality of ring members.

4. The pole type member support device in accordance with claim 1, comprising a gasket formed around an inner diameter of each of the plurality of ring members.

5. The pole type member support device in accordance with claim 1, wherein each of the plurality of rings are of a different outer diameter.

6. A pole type member support device comprising:

a receptacle having an opening formed in a top section thereof;

a tubular cut-out formed within the receptacle and extending down from the opening; and a plurality of ring members, wherein each ring member has an opening formed through a central area thereof, each opening having a diameter approximately equal to a diameter of a pole-type member, each of the plurality of ring members configured to be inserted and held within the tubular cut-out to support the pole-type member in an upright position within the tubular cut-out.

7. The pole type member support device in accordance with claim 6, comprising a plurality of ridge members formed along an inner surface of the tubular cut-out.

8. The pole type member support device in accordance with claim 6, comprising a gasket formed around an inner diameter of at least one of the plurality of ring members.

9. The pole type member support device in accordance with claim 6, comprising a gasket formed around an inner diameter of each of the plurality of ring members.

10. The pole type member support device in accordance with claim 6, wherein the tubular cutout is tapered so that the top section of the tubular cut-out is larger than a bottom section of the tubular cut-out.

11. The pole type member support device in accordance with claim 10, wherein each of the plurality of rings are of a different outer diameter.

12. The pole type member support device in accordance with claim 6, wherein the receptacle being conical in shaped and tapered so that the top section of the receptacle is smaller than a bottom section of the receptacle.

13. A pole type member support device comprising:

a receptacle having an opening formed in a top section thereof;

a tubular cut-out formed within the receptacle and extending down from the opening, wherein the tubular cutout is tapered so that the top section of the tubular cut-out is larger than a bottom section of the tubular cut-out; and a plurality of ring members, wherein each ring member has an opening formed through a central area thereof, each opening having a diameter approximately equal to a diameter of a pole-type member, each of the plurality of ring members configured to be inserted and held within the tubular cut-out to support the pole-type member in an upright position within the tubular cut-out, wherein each of the plurality of rings are of a different outer diameter.

14. The pole type member support device in accordance with claim 13, comprising a plurality of ridge members formed along an inner surface of the tubular cut-out.

15. The pole type member support device in accordance with claim 13, comprising a gasket formed around an inner diameter of at least one of the plurality of ring members.

16. The pole type member support device in accordance with claim 13, comprising a gasket formed around an inner diameter of each of the plurality of ring members.

17. The pole type member support device in accordance with claim 13, wherein the receptacle being conical in shaped and tapered so that the top section of the receptacle is smaller than a bottom section of the receptacle.

* * * * *